United States Patent [19]

Haug

[11] Patent Number: 4,781,230

[45] Date of Patent: Nov. 1, 1988

[54] TEMPLATE FOR USE IN CARVING A THREE-DIMENSIONAL OBJECT

[76] Inventor: Thomas L. Haug, 6001 S. Irvington, Tulsa, Okla. 74135

[21] Appl. No.: 61,453

[22] Filed: Jun. 15, 1987

[51] Int. Cl.[4] ..... B27M 3/00

[52] U.S. Cl. ..... 144/372; 144/144.5 R

[58] Field of Search ..... 144/144.5, 372; 33/562, 33/563, 565

[56] References Cited

U.S. PATENT DOCUMENTS 100,848 3/1870 Boult ..... 144/144.5

*Primary Examiner*—W. Donald Bray

*Attorney, Agent, or Firm*—Head & Johnson

[57] ABSTRACT

A template for use in carving a three dimensional object from a solid block, the template being formed of a stiff board of thin material having at least three spaced apart cut-out openings therethrough, the first opening conforming to a side elevational silhouette of the object, the second opening conforming to an end view silhouette of the object and a third opening conforming to a top view silhouette of the object. The desired object is then cut or carved to permit it to pass through each of the three openings in the stiff board with minimal clearance to thereby enable the user to conform the object to the desired basic configuration. The object can then be finished by rounding and smoothing.

3 Claims, 2 Drawing Sheets

TEMPLATE FOR USE IN CARVING A THREE-DIMENSIONAL OBJECT

SUMMARY OF THE INVENTION

Carving objects of art is one of mankind's oldest forms of artistic expression. An experienced sculptor, possessing artistic sculptoral aptitudes, can utilize a solid block, such as of wood, stone or other material and with a preconception of the ultimate appearance of the object, carve the object by removing portions of the block until the ultimately desired object is obtained. However, persons of lesser artistic gifts or experience frequently find it difficult to undertake a carving of an object from a block of wood or other material since it is difficult to predetermine the portions of the block which must be removed to attain the basic outline of the desired object.

A frequently employed method of teaching young people is to ask them to carve the shape of an object. For instance, in teaching Boy Scouts and Girl Scouts, a frequent exercise is to require them to carve an object of wildlife, such as a bird, a duck, a squirrel, etc. In the mental processes of forming the shape of a wildlife animal from a block, a younster can achieve immediate appreciation for the form and shape of the object, such as a bird, duck or other animal and this appreciation is indelibly engraved upon the mind of the young person and will stay with them much longer than merely reading about or viewing a picture of the object. For this reason a common training experience in groups, such as Boy Scouts and Girl Scouts, is to require the student to make a carving of an object of nature.

While students can usually put the finishing details on a carved object, a difficult aspect of requiring a student without previous experience as a carver or sculptor to produce an object of nature is that of first achieving the basic form of the object. The present invention provides a means whereby students can expeditiously carve an object and achieve great uniformity and realism in the basic structure of the object. To attain this goal a sheet is first prepared having three silhouette outlines of the object. For instance, if the goal of a student is to carve a duck from a block of wood, a drawing is first made of three silhouette outlines of a duck. The first silhouette outline is an elevational side view silhouette of the duck. The next drawing silhouette outline is a top view of a duck. The third outline is an end view silhouette of a duck. Obviously, rather than requiring the student to provide these outlines, the invention may be practiced by supplying the outlines for use by the student. The drawing having three outlines is then glued to a stiffer material, such as cardboard to form a template. Thereafter, the outlines are cut out to provide three openings in the template. Each of these openings conforms to one of the three silhouettes of the three dimensional objects.

The student then cuts or carves a block of material to pass with minimal clearance through these three cut-outs. In this way, the basic structural form of the object is attained. Thereafter, the student can complete the carving by rounding and smoothing the object, followed by painting the object with the colors characteristic of the object in nature.

In some instances it is desirable that the object be separated into two or more portions such that a duck may be formed of a body and a head portion. In this case the template is formed with three silhouette outline cut outs for each of the separate portions, such as three silhouettes defining the body and three silhouettes defining the head. After the head and body have been cut from separate blocks they may be assembled together and thereafter the completed carving finished.

The invention the template for use in achieving a basic carved structure of an ultimate object and the method of carving an object utilizing the template.

A better understanding of the invention will be had by reference to the following description and claims, taken in conjunction with the attached drawings.

DESCRIPTION OF THE VIEWS

DESCRIPTION OF THE PREFERRED EMBODIMENT

Figure 5:
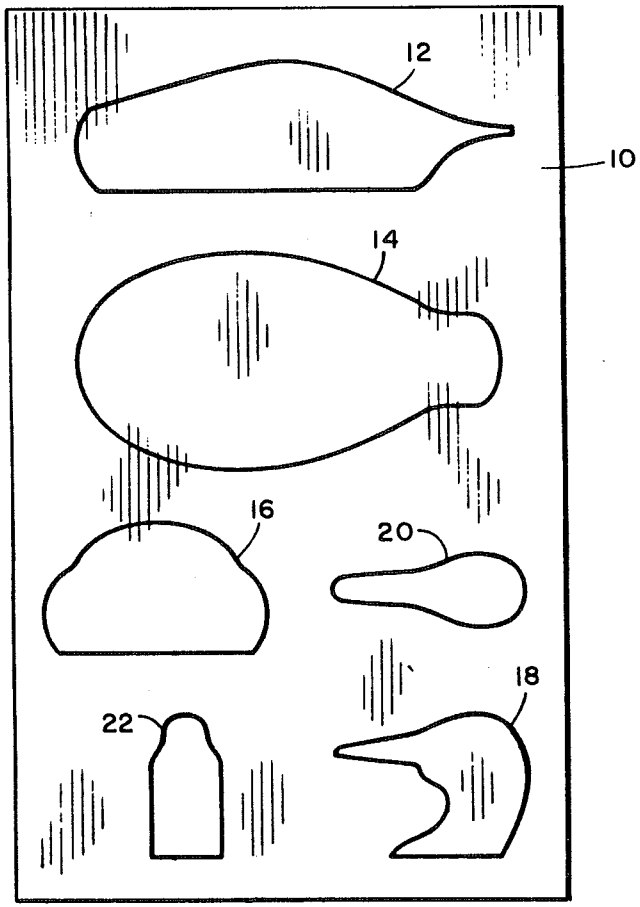
FIG. 5 is a front elevational view of the drawing of FIG. 1 showing in more detail exemplary shapes of silhouette designs utilized to carve a duck.

The invention will be described as it is employed in carving a duck, such as a canvas back duck common in the United States, it being understood that this is merely exemplary of the use of the principles of the invention to provide a template and a method of use thereof for carving any three-dimensional object from a solid block. The first step is to provide silhouette outlines of the object to be carved. It the entire object is to be carved of a single block of material, only three silhouette outlines are required. However, if the object is to be carved from two or more blocks and subsequently assembled, then three silhouette outlines are required for each separate piece to be carved. FIG. 5 shows a sheet 10, such as a sheet of paper, having silhouette outlines drawn thereon. Silhouette outline 12 is a side elevational silhouette outline of the body of a duck; 14 is a top silhouette outline of the body of a duck; and 16 is an end view silhouette outline of the body of a duck. Drawing 18 is a side elevational silhouette outline of the head of a duck. 20 is a top silhouette outline of the head of a duck. 22 is the end silhouette outline of the head of a duck. Sheet 10 may be prepared by the student or may be supplied to a student.

Figure 1:
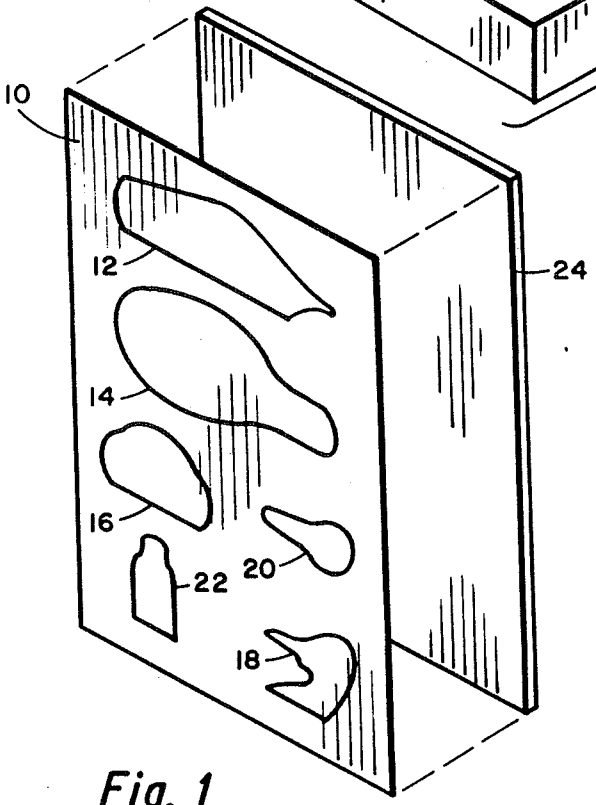
FIG. 1 is an exploded isometric view of a sheet, such as a sheet of paper, having silhouette outline drawings thereon and showing the sheet as preparatory for it being glued to a stiff backing, such as a sheet of cardboard.

To facilitate the use of sheet 10 it is preferably glued to a backing or cardboard 24 as shown in the exploded view of FIG. 1.

Figure 3:
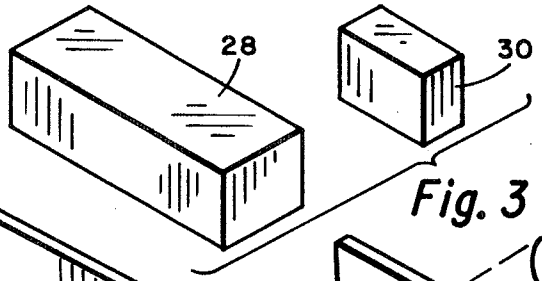
FIG. 3 is an isometric view of two blocks, such as blocks of wood, from which it is desired to form an object, such as a duck.

FIG. 3 shows two blocks from which a duck is to be carved. The larger block 26 which may be of wood, styrofoam, or other carveable material, has dimensions which exceed in length, width and height the maximum dimensions of the silhouette outlines 12, 14 and 16. The second block 28 has a length, width and height which exceeds the dimensions of outlines 18, 20, and 22.

Figure 4:
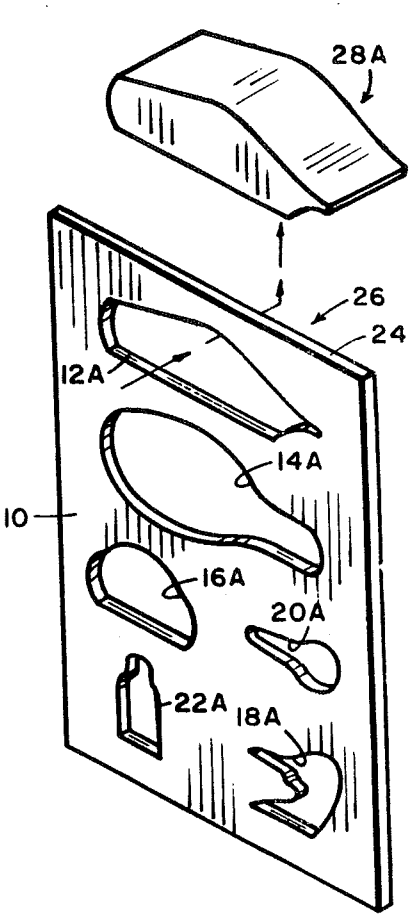
FIG. 4 shows the template of FIG. 2 with all of the silhouettes being cut-out, and showing the larger block of FIG. 3 having been cut or carved to pass with minimal clearance through the side elevational silhouette cut-out.
Figure 2:
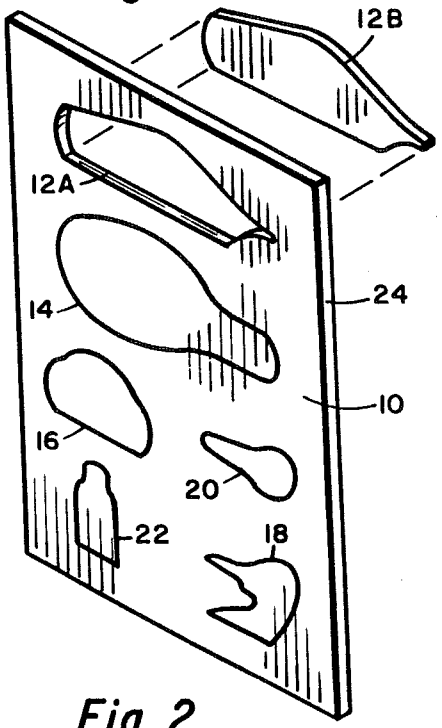
FIG. 2 shows the sheet and cardboard backing formed as a single unit and with one of the cut-outs removed.

FIG. 2 shows the sheet 10 glued to cardboard 24 and with material 12B being removed from the outline 12 providing a cut-out 12A conforming to the outline 12 of the sheet. FIG. 4 shows the sheet 10 and backing cardboard 24, which together form a template, with each of the outlines being cut-out thereby providing cut-outs 12A through 22A.

The first step in carving the duck body is to cut or carve block 26 to conform the side elevational view thereof to the cut-out 12A. This can be done either by the student visually forming the shape of the block so that the side elevational silhouette view fits the cut-out 12A or the cut-out 12A may be used as a pattern. The student may position the template onto block 26 and draw an outline of the cut-out 12A. Thereafter, the block may be sawed, such as on a band saw or jig saw, to produce the shape as shown in FIG. 4. The student can verify the shape is proper when it passes through the cut-out 12A with minimal clearance. In this manner the student can readily ascertain when additional material must be removed from the block to permit it to pass freely but with minimal clearance through the cut-out 12A.

Thereafter, the top silhouette cut-out 14A is employed. The block 28A as shown in FIG. 4 is cut or carved so that the top silhouette outline conforms to that of cut-out 14A. Again the cut-out 14A of the template may be used to draw an outline on the block 28A. The block may then be conformed to the top silhouette opening by use of a band saw or by carving. The student can verify the accuracy of the top silhouette by passing the carved block through the cut-out 14A.

This step is repeated for the body end view as per the end view silhouette cut-out 16A.

Figure 6:
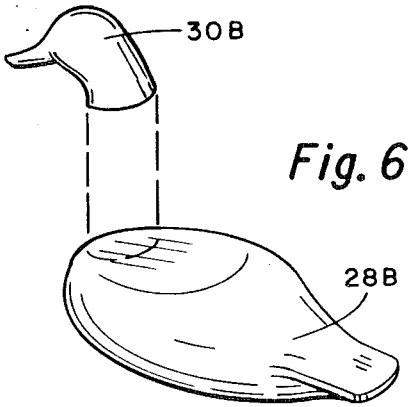
FIG. 6 shows in exploded view the body and head of a duck having been cut or carved to pass with minimal clearance through the silhouette outlines of the template of FIG. 4.

After the body block has been cut or carved so that it can pass through the three silhouette cut-outs 12A, 14A and 16A with minimal clearance, the body will have an appearance such as 28B of FIG. 6. While the body 28B after performing the cutting or carving as necessary to pass through the three silhouette outlines 12A, 14A and 16A will have rough corners, the student can easily round and smooth the corners to attain the natural shape of the duck body.

Figure 7:
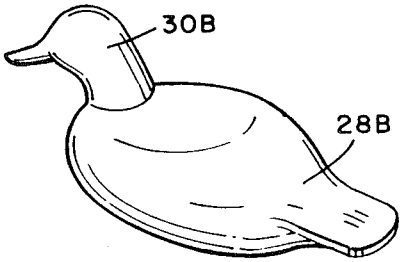
FIG. 7 shows the head and body assembled with the duck having been cut from the blocks of FIG. 3.

The process is repeated using block 30 to form the head of the duck. When the block 20 has been cut or carved so that is passes with minimal clearance through the cut-outs 18A, 20A and 22A, it will have an appearance as in 30B of FIG. 6. Like the body, the head 30B will have edges which must be smooth and contoured to obtain the final shape desired, but the basic structure will be revealed when the block 30 has been cut or carved to pass through the three silhouette openings 18A, 20A and 22B of the template 26. The final duck is then achieved by assembling the portions 28B and 30B together as in FIG. 7. The student can then finish the project by final sanding and polishing as necessary followed by painting the finished structure as desired.

It can be seen that by use of the template and techniques herein provided, an unskilled student can achieve a very successful and satisfying finished product without having more than minimal artistic competence. As previously indicated the process can be employed by first requiring the student to provide the silhouette drawing of FIG. 5 or the sheet of FIG. 5 may be supplied to the student along with blocks 28 and 30 or, the completed template 26 with the blocks 28 and 30 may be supplied the student. With this simple technique a student starting with two blocks 28 and 30 can achieve a satisfying result thereby increasing the student's appreciation of the object which has been carved and can further increase the student's appreciation of the art of sculpturing.

As previously stated, while the method of practicing the invention to achieve a duck has been illustrated, it can be seen that it equally applies to any other kind of wild life, including birds and animals, or to any other carved three dimensional object.

The claims and the specification describe the invention presented and the terms that are employed in the claims draw their meaning from the use of such terms in the specification. The same terms employed in the prior art may be broader in meaning than specifically employed herein. Whenever there is a question between the broader definition of such terms used in the prior art and the more specific use of the terms herein, the more specific meaning is meant.

While the invention has been described with a certain degree of particularity it is manifest that many changes may be made in the details of construction and the arrangement of components without departing from the spirit and scope of this disclosure. It is understood that the invention is not limited to the embodiments set forth herein for purposes of exemplification, but is to be limited only by the scope of the attached claim or claims, including the full range of equivalency to which each element thereof is entitled.

What is claimed is:

1. A template for use in carving a three dimensional object from a solid block comprising:

a template in the form of a stiff board of thin material having at least three spaced apart cut-out openings therethrough, the first opening conforming to a side elevational silhouette of the object, the second opening conforming to an end view silhouette of the object, and the third opening conforming to a top view silhouette of the object, whereby the block may be cut, or carved to permit it to be passed through each of said three openings in the template with minimal clearance to therby enable the user to conform the object cut or carved from a block to the basic configuration of the desired object.

2. A template according to claim 1 wherein the three dimensional object is achieved by assembly of two or more separately carved pieces from separate solid blocks and wherein said template includes said three spaced apart cut-out openings for each piece of the object, each opening being in the shape of different silhouettes of a piece whereby each piece may be cut or carved to pass with minimal clearance through appropriate cut-out openings to thereby enable the user to conform each piece of the object cut or carved from a block to the basic configuration of desired pieces of the object.

3. A method of carving a three dimensional object from a solid block comprising:

drawing an outline of three silhouettes of the object on a sheet, the first outline being a side elevational silhouette of the object, the second outline being an end view silhouette of the object, and the third outline being a top view silhouette of the object;

cutting out the outlines of the three silhouettes providing a template having three cut-out openings therein;

cutting or carving a solid block to permit its passage with minimal clearance through said three cut-out openings in said template to thereby obtain a model having the basic configuration of the desired object; and rounding and smoothing the model having the basic configuration to achieve the desired three dimensional object.

* * * * *